US007928708B2

(12) United States Patent
Takada et al.

(10) Patent No.: US 7,928,708 B2
(45) Date of Patent: Apr. 19, 2011

(54) CONSTANT-VOLTAGE POWER CIRCUIT

(75) Inventors: Shuichi Takada, Yokohama (JP); Takeshi Abiru, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 342 days.

(21) Appl. No.: 12/108,704

(22) Filed: Apr. 24, 2008

(65) Prior Publication Data

US 2008/0265856 A1 Oct. 30, 2008

(30) Foreign Application Priority Data

Apr. 27, 2007 (JP) ..... 2007-120064

(51) Int. Cl.
*G05F 3/16* (2006.01)
*G05F 1/563* (2006.01)

(52) U.S. Cl. ..... 323/274; 323/314

(58) Field of Classification Search ..... 323/266, 323/269, 273, 274, 312, 314
See application file for complete search history.

(56) References Cited

U.S. PATENT DOCUMENTS

| | | | | |
|---|---|---|---|---|
| 5,838,145 | A | 11/1998 | Poon et al. | |
| 7,221,132 | B2 | 5/2007 | Okubo et al. | |
| 7,221,213 | B2 * | 5/2007 | Lee et al. | 327/541 |
| 7,282,902 | B2 | 10/2007 | Chang et al. | |
| 7,336,058 | B1 * | 2/2008 | Lo et al. | 323/269 |
| 7,619,396 | B2 * | 11/2009 | Chuang et al. | 323/269 |

* cited by examiner

*Primary Examiner* — Gary L Laxton
(74) *Attorney, Agent, or Firm* — Turocy & Watson, LLP

(57) ABSTRACT

A differential amplifier receives a reference voltage and a divided voltage dividing an output voltage, and outputs a control voltage in accordance with the difference between the reference voltage and the divided voltage. The control voltage output from the differential amplifier is supplied to an output amplifier. The output amplifier generates a stabilized output voltage from a high-potential-side power supply voltage in accordance with the control voltage. A P-type MOS transistor is connected to a node of the output voltage, and the MOS transistor carries a current from the node of the output voltage. A current control circuit controls a gate of the P-type MOS transistor so that the current flowing through the P-type MOS transistor becomes a constant value.

18 Claims, 6 Drawing Sheets

PRIOR ART

CONSTANT-VOLTAGE POWER CIRCUIT

CROSS-REFERENCE TO RELATED APPLICATIONS

This application is based upon and claims the benefit of priority from prior Japanese Patent Application No. 2007-120064, filed Apr. 27, 2007, the entire contents of which are incorporated herein by reference.

BACKGROUND OF THE INVENTION

1. Field of the Invention

The present invention relates to a constant-voltage power circuit, which supplies a stable voltage with respect to transient variations of a load current.

2. Description of the Related Art

A linear regulator circuit is a so-called constant-voltage power circuit. The linear regulator circuit is largely classified into two; namely, it is composed of a differential amplifier and an output amplifier. In a low drop-out type linear regulator circuit outputting a voltage close to a power supply voltage, a P-type MOS transistor is used as an output transistor in general. However, if the P-type MOS transistor is used as the output transistor, the following problem arises. Specifically, low drop-out is realized, but the output voltage varies with respect to variations of a load current. In order to prevent the foregoing output variations, a large-size capacitor is required as an output transistor. If the constant-voltage power circuit is applied to mobile terminals, circuits of latest mobile terminals are minimized; for this reason, it is desired to make the size of the capacitor small.

BRIEF SUMMARY OF THE INVENTION

According to a first aspect of the present invention, there is provided a constant-voltage power circuit comprising:

a control voltage output circuit receiving a reference voltage and a divided voltage dividing an output voltage, and outputting a control voltage in accordance with the difference between the reference voltage and the divided voltage;

an output circuit receiving the control voltage to generate a stabilized output voltage from a high-potential-side power supply voltage;

a first P-type MOS transistor carrying a current from a node of the output voltage;

a capacitor connected between the node of the output voltage and a supply node of low-potential-side power supply voltage; and a P-type MOS transistor current control circuit controlling a gate of the first P-type MOS transistor so that a current flowing through the first P-type MOS transistor becomes a constant value.

According to a second aspect of the present invention, there is provided a constant-voltage power circuit comprising:

a control voltage output circuit receiving a reference voltage and a divided voltage dividing an output voltage, and outputting a control voltage in accordance with the difference between the reference voltage and the divided voltage;

an output circuit receiving the control voltage to generate a stabilized output voltage from a high-potential-side power supply voltage;

a first N-type MOS transistor carrying a current into a node of the output voltage;

a capacitor connected between the node of the output voltage and a supply node of low-potential-side power supply voltage; and an N-type MOS transistor current control circuit controlling a gate of the first N-type MOS transistor so that a current flowing through the first N-type MOS transistor becomes a constant value.

According to a third aspect of the present invention, there is provided a constant-voltage power circuit comprising:

a control voltage output circuit receiving a reference voltage and a divided voltage dividing an output voltage, and outputting a control voltage in accordance with the difference between the reference voltage and the divided voltage;

an output circuit receiving the control voltage to generate a stabilized output voltage from a high-potential-side power supply voltage;

a first P-type MOS transistor carrying a current from a node of the output voltage;

a first N-type MOS transistor carrying a current into a node of the output voltage;

a capacitor connected between the node of the output voltage and a supply node of low-potential-side power supply voltage;

a P-type MOS transistor current control circuit controlling a gate of the first P-type MOS transistor so that a current flowing through the first P-type MOS transistor becomes a constant value; and an N-type MOS transistor current control circuit controlling a gate of the first N-type MOS transistor so that a current flowing through the first N-type MOS transistor becomes a constant value.

DETAILED DESCRIPTION OF THE INVENTION

A constant-voltage power circuit according to the reference example will be hereinafter explained before various embodiments of the present invention will be described.

Reference Example

Figure 1:
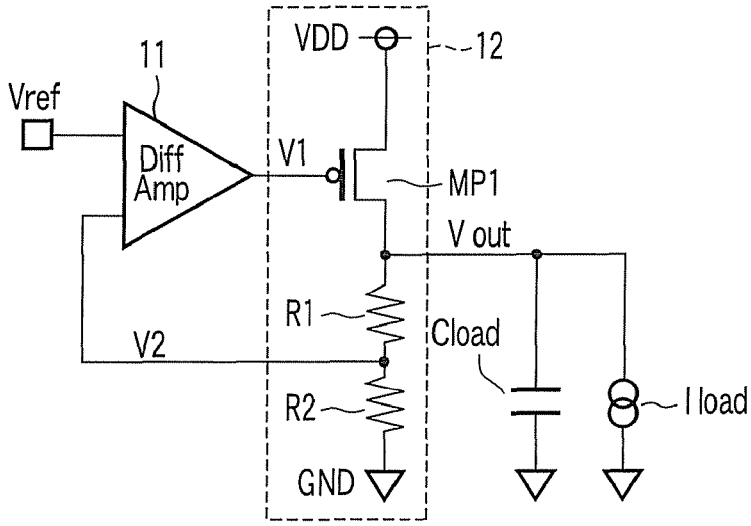
FIG. 1 is a circuit diagram showing the configuration of a constant-voltage power circuit according to a reference example.

FIG. 1 shows the configuration of a constant-voltage power circuit according to the reference example. The constant-voltage power circuit of FIG. 1 is composed of a differential amplifier (diff amp) 11, an output amplifier 12 and a capacitor Cload. The differential amplifier 11 is supplied with a reference voltage Vref and a divided voltage V2 feeding back from the output amplifier, and outputs a control voltage V1. The output amplifier 12 is composed of a P type MOS transistor MP1, two resistors R1 and R2 dividing an output voltage Vout to generate a divided voltage V2. The control voltage V1 output from the differential amplifier 11 is supplied to the gate of a P-type MOS transistor MP1. The source of the P-type MOS transistor MP1 is connected to a supply node of power supply voltage VDD, and the drain thereof is connected to a node of an output voltage Vout. A load current Iload flows from the node of the output voltage Vout. The differential amplifier 11 generates a control voltage V1 in accordance with the difference between the reference voltage Vref and the divided voltage V2. The output amplifier 12 outputs a voltage Vout in accordance with the control voltage V1.

The constant-voltage power circuit shown in FIG. 1 requires a capacitor having a sufficiently large value as the capacitor Cload to prevent output voltage variations. Thus, the capacitor having a large value is made the size large. Conversely, if the value of the capacitor Cload is small, variations of the output voltage Vout are not restricted with respect to transient variations of the load current Iload as seen from FIG. 2. As a result, the stable supply of the output voltage Vout is not realized.

Figure 2:
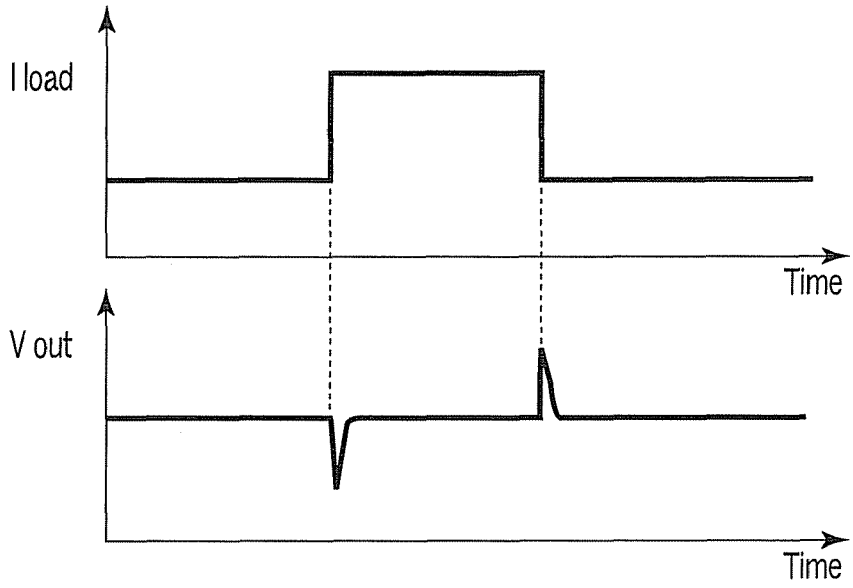
FIG. 2 is a characteristic chart showing each change of a load current and an output voltage in the constant-voltage power circuit according to the reference example as shown in FIG. 1.

Specifically, as shown in FIG. 2, when the load current Iload increases, the output voltage Vout temporarily decreases. Conversely, when the load current Iload decreases, the output voltage Vout temporarily increases. When the load current Iload relatively later increases, a change of the load current Iload changes an output of the differential amplifier 11. Thus, a gate-source voltage Vgs of the P-type MOS transistor MP1 is increased. Therefore, variations of the output voltage Vout does not almost occurs because a current Iload supplied from the P-type MOS transistor MP1 to a load increases. However, when a change of the load current Iload is relatively fast, the control of the P-type MOS transistor MP1 by the differential amplifier 11 is not made in time. Thus, the output voltage Vout must be decreased to increase the foregoing Vgs. As a result, the output voltage Vout continues to decrease until the differential amplifier 11 starts to operate.

Various embodiments of the present invention will be hereinafter described. In the following description, the same reference numerals are used to designate common portions over all drawings.

First Embodiment

Figure 3:
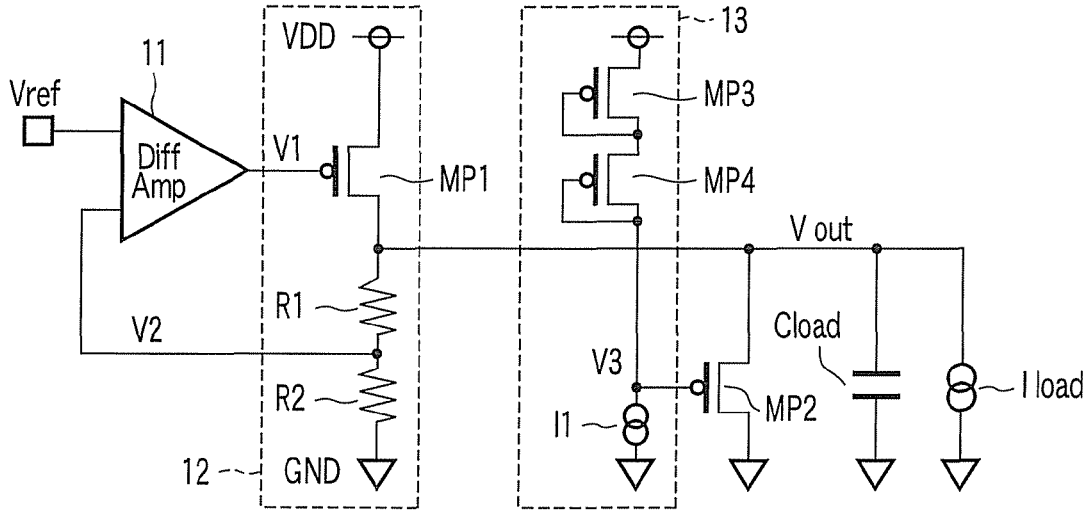
FIG. 3 is a circuit diagram showing the configuration of a constant-voltage power circuit according to a first embodiment.

FIG. 3 shows the configuration of a constant-voltage power circuit according to a first embodiment. The constant-voltage power circuit according to this embodiment has a differential amplifier (diff amp, control voltage output circuit) 11, an output amplifier (output circuit) 12 and a capacitor Cload. The differential amplifier 11 is supplied with a reference voltage Vref and a divided voltage V2 fed back from the output amplifier, and outputs a control voltage V1. The output amplifier 12 is composed of a P-type MOS transistor MP1 and two resistors R1 and R2 dividing an output voltage Vout to a divided voltage V2. The control voltage V1 output from the differential amplifier 11 is supplied to a gate of the MOS transistor MP1. A source of the MOS transistor MP1 is connected to a supply node of power supply voltage VDD, and a drain thereof is connected to a node of an output voltage Vout. The foregoing two resistors R1 and R2 are connected in series between the node of the output voltage Vout and ground. The differential amplifier 11 generates a control voltage V1 in accordance with the difference between the reference voltage Vref and the divided voltage V2. The output amplifier 12 outputs a voltage Vout in accordance with the control voltage V1. A load current Iload is carried from the node of the output voltage Vout.

The constant-voltage power circuit according to this embodiment further has a P-type MOS transistor MP2, and a current control circuit (P-type MOS transistor current control circuit) 13. A source of the MOS transistor MP2 is connected to a node of an output voltage Vout, and a drain thereof is connected to ground.

The current control circuit 13 is composed of a constant-current source I1, two P-type MOS transistors MP3 and MP4. One terminal of the constant-current source I1 is connected to ground (supply node of low-potential-side power supply voltage). The foregoing MOS transistors MP3 and MP4 each have gate and drain mutually connected. A current path between source and drain is interposed in series between a supply node of power supply voltage VDD (supply node of high-potential-side power supply voltage) and the other terminal of the constant-current source I1. The gate of the MOS transistor MP2 is connected to the other terminal of the constant-current source I1. According to this embodiment, the current control circuit 13 is provided with two P-type MOS transistors MP3 and MP4. In this case, the current control circuit 13 may be provided with at least one P-type MOS transistor having gate and drain mutually connected.

The current control circuit 13 is a circuit, which generates a control voltage V3 used so that the P-type MOS transistor MP2 connected between the node of the output voltage Vout and ground always carries a constant current. A current value carried from the node of the output voltage Vout by the MOS transistor MP2 determines depending on a threshold voltage Vth (Vth is a negative value) of the MOS transistor MP2 and the gate-source voltage Vgs. If the threshold voltage of the MOS transistor MP2 becomes higher than a design value due to an influence of a manufacturing process (negative value increases), a current flowing through the MOS transistor MP2 is decreased compared with the design value. However, the threshold voltage Vth of the same P-type two MOS transistors MP3 and MP4 becomes high likewise (negative value increases). In order to carry a constant current to the constant-current source I1, a voltage between VDD-V3 becomes large, and thus, the control voltage V3 drops down. The control voltage V3 drops down, and thereby, the gate-source voltage Vgs of the MOS transistor MP2 becomes large, and thus, a current carried by the MOS transistor MP2 increases. Therefore, the threshold voltage Vth becomes high, and the gate-source voltage Vgs becomes high. This serves to offset increase and decrease of the current flowing through the MOS transistor MP2. As a result, the MOS transistor MP2 continues to carry a constant current regardless of variations of the threshold voltage Vth.

Conversely, if the threshold voltage Vth of the MOS transistor becomes lower than a design value (negative value decreases), a current flowing through the MOS transistor MP2 increases compared with the design value. However, in this case, the control voltage V3 drops up, and thus, increase and decrease of the current carried by the MOS transistor MP2 is offset. In other words, the current control circuit 13 controls the value of the control voltage V3 in accordance with variations of the threshold voltage Vth of the P-type MOS transistors MP2. Therefore, the current control circuit 13 can employ various configurations without being limited to the configuration shown in FIG. 3 so long as the value of the output voltage V3 changes in accordance with the threshold voltage Vth of the P-type MOS transistor MP2.

Figure 4:
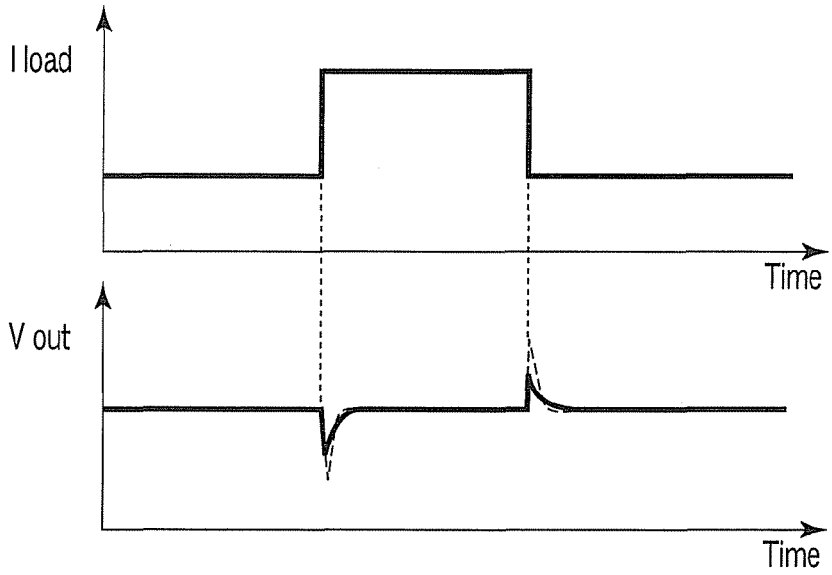
FIG. 4 is a characteristic chart showing each change of a load current and an output voltage in the constant-voltage power circuit according to the first embodiment.

The operation of the circuit of the first embodiment shown in FIG. 3 will be hereinafter described with reference to FIG. 4. FIG. 4 is a characteristic chart showing a change of a load current Iload and an output voltage Vout. In FIG. 4, a change of the output voltage Vout in the circuit of the first embodiment shown in FIG. 3 is shown by a solid line. On the other hand, a change of the output voltage Vout in the circuit of the reference example shown in FIG. 1 is shown by a broken line.

Now, when the load current Iload increases while the output voltage Vout drops, the gate-source voltage Vgs of the MOS transistor MP2 decreases. Thus, a current flowing through the MOS transistor MP2 decreases, and an increase of current of the load current Iload is offset. In this way, as seen from the solid line of FIG. 4, variations of the output voltage Vout is small compared with the case of the reference example shown by the broken line.

Conversely, when the voltage of the output voltage Vout increases while the load current Iload decreases, the gate-source voltage Vgs of the MOS transistor MP2 increases. A current carrying the MOS transistor MP2 increases, and thus, a decrease of the load current Iload flows through the MOS transistor MP2 in excess. In this way, even if the load current Iload decreases, as seen from the solid line of FIG. 4, variations of the output voltage Vout is small compared with the case of the reference example shown by the broken line.

Figure 5:
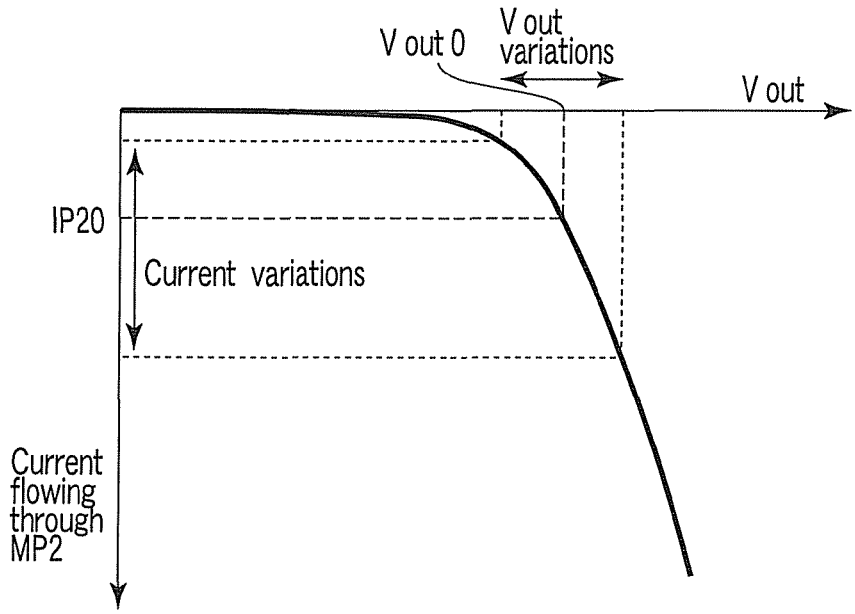
FIG. 5 is a characteristic chart showing a change of an output voltage and a current flowing through a MOS transistor MP2 in the constant-voltage power circuit according to the first embodiment.

FIG. 5 is a graph showing a change of an output voltage Vout and a current flowing through the MOS transistor MP2. In FIG. 5, the direction flowing to ground is set as negative in the current flowing through the MOS transistor MP2. An output voltage when the load current Iload is constant is set as Vout0, and a current flowing through the MOS transistor MP2 at that time is set as IP20.

When the load current Iload increases and a value of the output voltage is decreased less than Vout0, the current flowing through the MOS transistor MP2 decreases from IP20 as seen from FIG. 5. Thus, an increase of the load current Iload is offset; therefore, the value of the output voltage returns to Vout0. Conversely, the load current Iload decreases and a value of the output voltage is increased more than Vout0, as seen from FIG. 5, the current flowing through the MOS transistor increases from IP20. Thus, a decrease of the load current Iload is added to IP20; therefore, the output voltage value returns to Vout0.

In the constant-voltage power circuit of the first embodiment, even if the output voltage Vout slightly drops down from the power supply voltage VDD, the MOS transistor MP2 turns on. Therefore, this serves to largely prevent variations of the output voltage Vout in transient response time while realizing low drop out. In addition, a capacitor Cload having a large value is not required; therefore, the circuit integration is easy.

Second Embodiment

Figure 6:
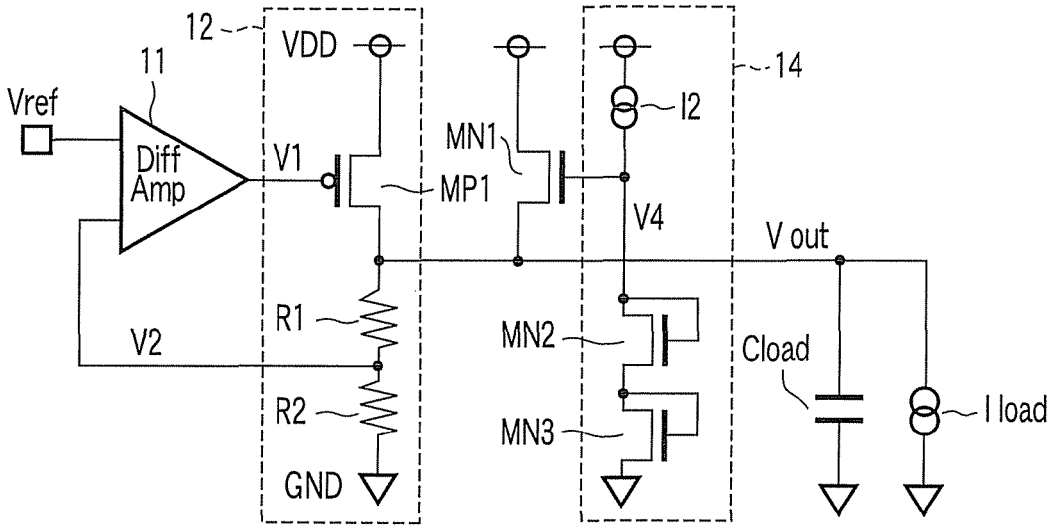
FIG. 6 is a circuit diagram showing the configuration of a constant-voltage power circuit according to a second embodiment.

FIG. 6 shows the configuration of a constant-voltage power circuit according to a second embodiment. The circuit of this embodiment has a differential amplifier 11, an output amplifier 12 and a capacitor Cload as in the case of the constant-voltage power circuit of the first embodiment. The foregoing differential amplifier 11 and output amplifier 12 each have the same configuration as shown in FIG. 3. A current Iload flows from a node of an output voltage Vout.

The circuit of this embodiment further has an N-type MOS transistor MN1, and a current control circuit (N-type MOS transistor current control circuit) 14. The MOS transistor MN1 has a source connected to the node of the output voltage Vout, and a drain connected to a supply node of power supply voltage VDD.

The current control circuit 14 is composed of a constant-current source I2, two N-type MOS transistors MN2 and MN3. One terminal of the constant-current source I2 is connected to the supply node of power supply voltage VDD (supply node of high-potential-side power supply voltage). The foregoing MOS transistors MN2 and MN3 each have mutually connected gate and drain. A current path between source and drain is interposed in series between the other terminal of the constant-current source I2 and ground (supply node of low-potential-side power supply voltage). The gate of the MOS transistor MN1 is connected to the other terminal of the constant-current source I2. According to the second embodiment, the current control circuit 14 is provided with two N-type MOS transistors MN2 and MN3. In this case, the current control circuit 14 may be provided with at least one N-type MOS transistor having gate and drain connected.

The current control circuit 14 is a circuit, which generates a control voltage V4 used for controlling so that the N-type MOS transistor MN1 connected between the supply node of power supply voltage VDD and the node of the output voltage Vout always carries a constant current. A current value carrying into the node of the output voltage Vout by the MOS transistor MN1 determines by a threshold voltage Vth (positive value) of the MOS transistor MN1 and a gate-source voltage Vgs thereof. If the threshold voltage Vth of the MOS transistor MN1 becomes higher than a design value due to an influence of a manufacturing process (positive value increases), a current flowing through the MOS transistor MN1 decreases compared with the design value. However, the threshold voltage Vth of the same two N-type MOS transistors MN2 and MN3 becomes high likewise. Thus, a voltage between V4-GND becomes large to carry a constant current to the constant-current source I2, and therefore, the control voltage increases. When the control voltage V4 increases, the gate-source voltage Vgs of the MOS transistor Mn1 becomes large. Thus, a current flowing through the MOS transistor MN1 increases. Therefore, the threshold voltage Vth becomes high, and also, the gate-source voltage Vgs becomes high. This serves to offset increase and decrease of a current flowing through the MOS transistor MN1, and the MOS transistor MN1 continues to carry a constant current regardless of variations of the threshold voltage Vth.

Conversely, if the threshold voltage Vth becomes lower than a design value (positive value decreases), a current flowing through the MOS transistor MN1 increases more than the design value. But, in this case, the control voltage V4 drops down, and increase and decrease of a current carried by the MOS transistor MN1 is offset. In other words, the current control circuit 14 controls a value of the control voltage V4 in accordance with variations of the threshold voltage Vth of the N-type MOS transistor. Therefore, the current control circuit 14 is not limited to the configuration shown in FIG. 6 so long as the value of the output voltage V4 changes in accordance with the threshold voltage of the N-type MOS transistor. Thus, circuits having various configurations are employed.

Figure 7:
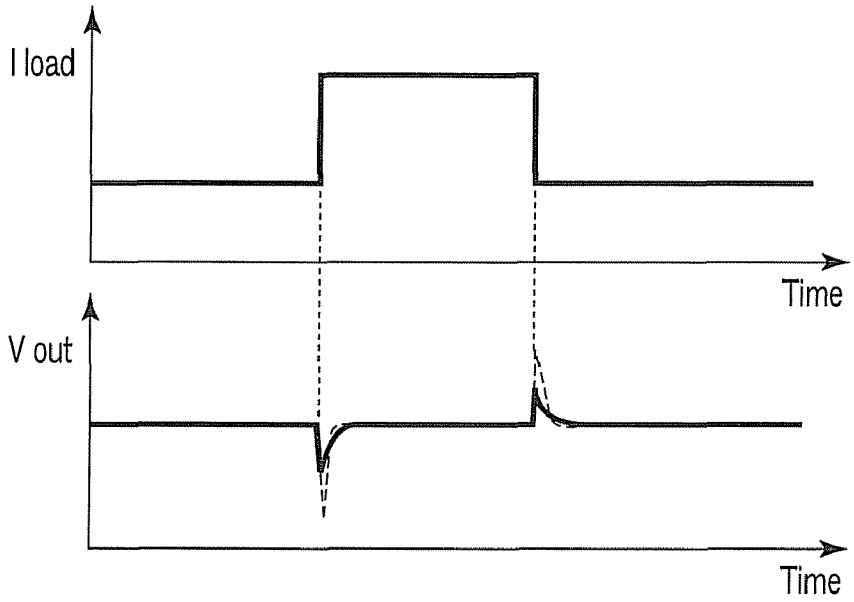
FIG. 7 is a characteristic chart showing each change of a load current and an output voltage in the constant-voltage power circuit according to the second embodiment.

The operation of the circuit of the first embodiment shown in FIG. 6 will be hereinafter described with reference to FIG. 7. FIG. 7 is a characteristic chart showing a change of a load current Iload and an output voltage Vout. In FIG. 7, a change of the output voltage Vout in the circuit of the first embodiment shown in FIG. 6 is shown by a solid line. On the other hand, a change of the output voltage Vout in the circuit of the reference example shown in FIG. 1 is shown by a broken line.

Now, when the load current Iload increases while the output voltage Vout drops, the gate-source voltage Vgs of the MOS transistor MN1 increases. Thus, a current flowing through the MOS transistor MN1 increases, and an increase of current of the load current Iload is offset. In this way, as seen from the solid line of FIG. 7, variations of the output voltage Vout is small compared with the case of the reference example shown by the broken line.

Conversely, when the voltage of the output voltage Vout increases while the load current Iload decreases, the gate-source voltage Vgs of the MOS transistor MN1 decreases. A current carrying the MOS transistor MN1 decreases, and thus, a current flowing through the MOS transistor MN1 decreases by a decrease of the current of the load current Iload. In this way, even if the load current Iload decreases, as seen from the solid line of FIG. 7, variations of the output voltage Vout is small compared with the case of the reference example shown by the broken line.

Figure 8:
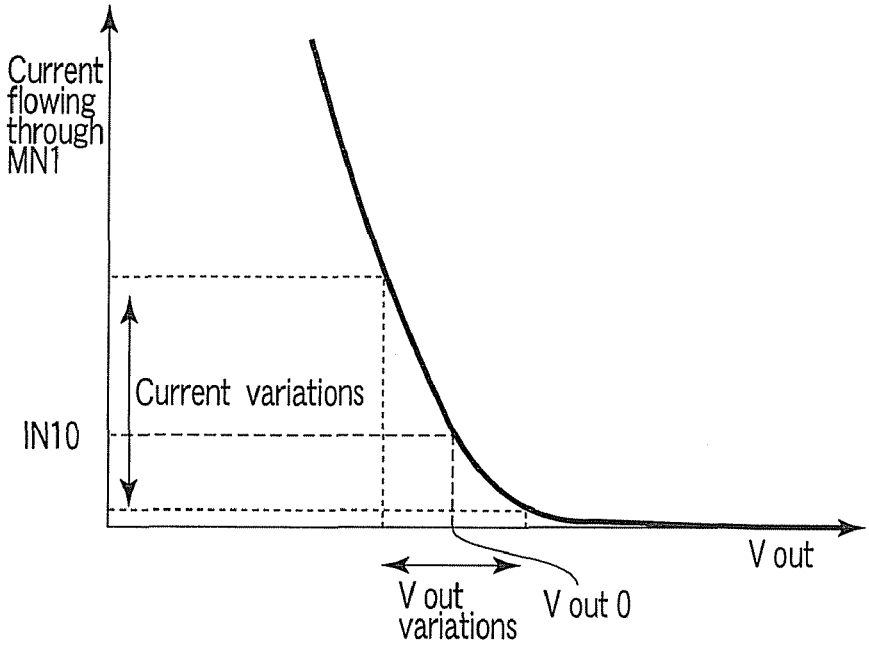
FIG. 8 is a characteristic chart showing a change of an output voltage and a current flowing through a MOS transistor MN1 in the constant-voltage power circuit according to the second embodiment.

FIG. 8 is a graph showing a change of an output voltage Vout and a current flowing through the MOS transistor MN1. An output voltage when a load current Iload is constant is set as Vout0, and a current flowing trough the MOS transistor MN1 at that time is set as IN10.

When the load current Iload increases while a value of the output voltage decreases from Vout0, the current flowing through the MOS transistor MN1 increases from IN10 as seen from FIG. 8. An increase of the load current Iload is offset, and thus, the value of the output voltage returns to Vout0. Conversely, when the load current Iload decreases while the value of the output voltage increases from Vout0, the current flowing through the MOS transistor MN1 decreases from IN10 as seen from FIG. 8. Then, a decrease of the load current Iload is added to I10, and thus, the output voltage value returns to Vout0.

In the circuit of the second embodiment, it is possible to considerably prevent variations of the output voltage Vout in transient response time as in the case of the circuit of the first embodiment shown in FIG. 3. In addition, a current flowing through the N-type MOS transistor MN1 is inherently a part of current Iload flowing through a load. Therefore, low power consumption is realized compared with the circuit of the first embodiment shown in FIG. 3. A capacitor having large value is not required as the capacitor Cload; therefore, circuit integration is easy.

Third Embodiment

Figure 9:
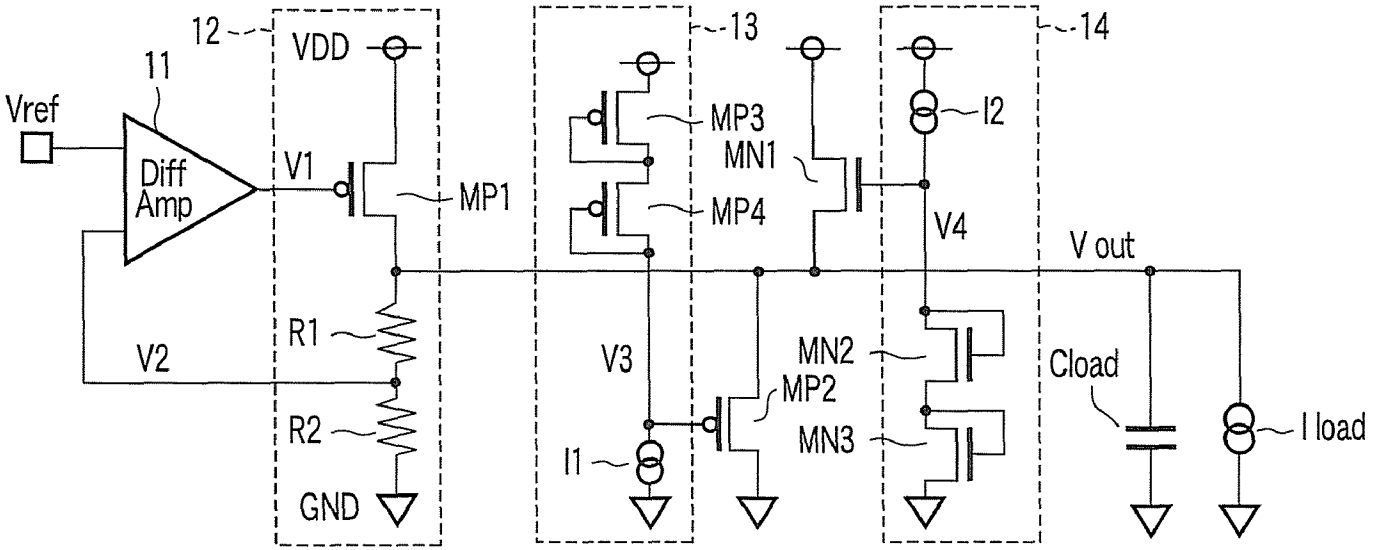
FIG. 9 is a circuit diagram showing the configuration of a constant-voltage power circuit according to a third embodiment.

FIG. 9 shows the configuration of a constant-voltage power circuit according to a third embodiment. The constant-voltage power circuit of this embodiment has a differential amplifier 11 and an output amplifier 12 as in the cases of FIGS. 3 and 6. The foregoing differential amplifier 11 and output amplifier 12 have the same configuration as shown in FIGS. 3 and 6. A node of an output voltage Vout is connected with a capacitor Cload and a current Iload as a load.

The constant-voltage power circuit of this embodiment further has a P-type MOS transistor MP2, current control circuit (P-type MOS transistor current control circuit) 13 as in the case of FIG. 3, and an N-type MOS transistor MN1, current control circuit (N-type MOS transistor current control circuit) 14 as in the case of FIG. 6.

As described in the first and second embodiments, the current control circuit 13 controls a value of a control voltage V3 in accordance with variations of a threshold voltage Vth of the P-type MOS transistor. The current control circuit 14 controls a value of a control voltage V4 in accordance with variations of a threshold voltage Vth of the N-type MOS transistor. In addition, as described in the first and second embodiments, the foregoing current control circuits 13 and 14 may be each provided with at least one P- or N-type MOS transistor having gate and drain mutually connected.

Figure 10:
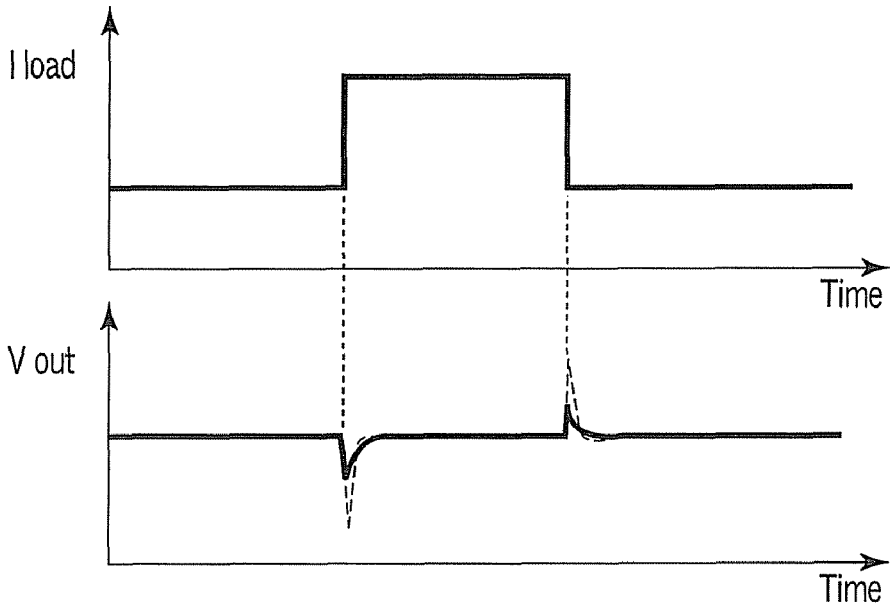
FIG. 10 is a characteristic chart showing each change of a load current and an output voltage in the constant-voltage power circuit according to the third embodiment.

The operation of the circuit of the first embodiment shown in FIG. 10 will be hereinafter described with reference to FIG. 9. FIG. 10 is a characteristic chart showing a change of a load current Iload and an output voltage Vout. In FIG. 10, a change of the output voltage Vout in the circuit of the first embodiment shown in FIG. 9 is shown by a solid line. On the other hand, a change of the output voltage Vout in the circuit of the reference example shown in FIG. 1 is shown by a broken line.

When the load current Iload increases while the value of the output voltage Vout decreases, a gate-source voltage Vgs of the P-type MOS transistor MP2 decreases. Thus, a current flowing through the P-type MOS transistor MP2 decreases. Likewise, a gate-source voltage Vgs of the N-type MOS transistor MN1 increases. Thus, a current flowing through the P-type MOS transistor MN1 increases. In the circuit of this embodiment, variations of the output voltage Vout when the load current Iload increases is small compared with the circuits of the first and second embodiments by mutually potentiating effect of the P-type MOS transistor MP2 and the N-type MOS transistor MN1.

Conversely, when the load current Iload decreases while the value of the output voltage Vout increases, a gate-source voltage Vgs of the P-type MOS transistor MP2 increases. Thus, a current flowing through the P-type MOS transistor MP2 increases. Likewise, a gate-source voltage Vgs of the N-type MOS transistor MN1 decreases. Thus, a current flowing through the N-type MOS transistor MN1 decreases. In the circuit of this embodiment, variations of the output voltage Vout when the load current Iload decreases is small compared with the circuits of the first and second embodiments by mutually potentiating effect of the P-type MOS transistor MP2 and the N-type MOS transistor MN1.

Figure 11:
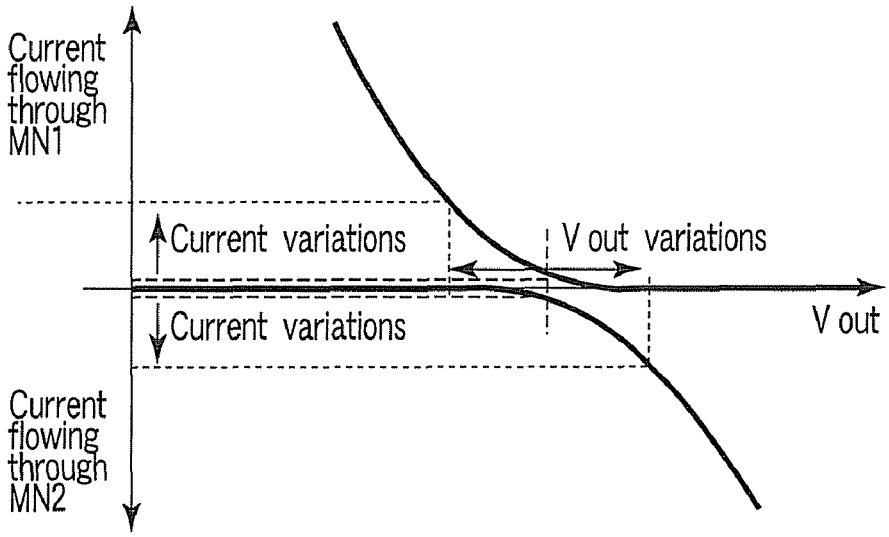
FIG. 11 is a characteristic chart showing a change of an output voltage and a current flowing through MOS transistors MP2 and MN1 in the constant-voltage power circuit according to the third embodiment.

FIG. 11 is a graph showing a change of an output voltage Vout and a current flowing through P-type and N-type MOS transistors MP2 and MN1. In FIG. 11, the direction flowing to ground is set as negative in the current flowing through the MOS transistor MP2. As shown in FIG. 11, when the output voltage Vout decreases, a current flowing through the N-type MOS transistor MN1 mainly increases. Conversely, when the output voltage Vout increases, a current flowing through the P-type MOS transistor MP2 mainly increases. As a result, the operation is made in a wide range with respect to variations of the output voltage Vout regardless of variations of current value.

The constant-voltage power circuit of this embodiment realizes low drop-out characteristic and low power consumption, and considerably prevents variations of the output voltage in transient response time. In addition, a capacitor having a large value is not required as the capacitor Cload; therefore, circuit integration is easy.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A constant-voltage power circuit comprising:

a control voltage output circuit receiving a reference voltage and a divided voltage dividing an output voltage, and outputting a control voltage in accordance with the difference between the reference voltage and the divided voltage;

an output circuit receiving the control voltage to generate a stabilized output voltage from a high-potential-side power supply voltage, wherein the output circuit includes an output node to output the stabilized output voltage;

a first P-type MOS transistor carrying a current from the output node;

a capacitor connected between the output node and a supply node of low-potential-side power supply voltage; and a P-type MOS transistor current control circuit controlling a gate of the first P-type MOS transistor so that a current flowing through the first P-type MOS transistor becomes a constant value, wherein the P-type MOS transistor current control circuit includes:

a constant-current source having a first terminal and a second terminal, the first terminal being connected to the supply node of low-potential-side power supply voltage; and at least one second P-type MOS transistor having gate and drain mutually connected, and a current path between source and drain, which is interposed between a supply node of the high-potential-side power supply voltage and the second terminal of the constant-current source, wherein the gate of the first P-type MOS transistor is connected to the other terminal of the constant-current source.

2. The circuit according to claim 1, wherein the output circuit includes a third P-type MOS transistor having a current path between source and drain, and a gate, and whose current path is interposed between the supply node of the high-potential-side power supply voltage and the output node, and further, whose gate receives the control voltage.

3. The circuit according to claim 2, wherein the output circuit further includes a pair of resistors connected in series between the output node and the supply node of the low-potential-side power supply voltage, and the divided voltage is generated in a serial connection node of the paired resistors.

4. The circuit according to claim 1, wherein said at least one second P-type MOS transistor is two P-type MOS transistors having a current path between source and drain, which is interposed in series between the supply node of the high-potential-side power supply voltage and the output node.

5. The circuit according to claim 1, wherein said at least one second P-type MOS transistor is one P-type MOS transistors having a current path between source and drain, which is interposed between the supply node of the high-potential-side power supply voltage and the output node.

6. The circuit according to claim 1, wherein the control voltage output circuit is a differential amplifier, which has a pair of input terminals receiving the reference voltage and the divided voltage.

7. A constant-voltage power circuit comprising:

a control voltage output circuit receiving a reference voltage and a divided voltage dividing an output voltage, and outputting a control voltage in accordance with the difference between the reference voltage and the divided voltage;

an output circuit receiving the control voltage to generate a stabilized output voltage from a high-potential-side power supply voltage, wherein the output circuit includes an output node to output the stabilized output voltage;

a first N-type MOS transistor carrying a current into the output node;

a capacitor connected between the output node and a supply node of low-potential-side power supply voltage; and an N-type MOS transistor current control circuit controlling a gate of the first N-type MOS transistor so that a current flowing through the first N-type MOS transistor becomes a constant value, wherein the N-type MOS transistor current control circuit includes:

a constant-current source having a first terminal and a second terminal, the first terminal is connected to the supply node of high-potential-side power supply voltage; and at least one second N-type MOS transistor having gate and drain mutually connected, and a current path between source and drain, which is interposed between a supply node of the low-potential-side power supply voltage and the second terminal of the constant-current source, wherein the gate of the first N-type MOS transistor is connected to the second terminal of the constant-current source.

8. The circuit according to claim 7, wherein the output circuit includes a first P-type MOS transistor having a current path between source and drain, and a gate, and whose current path is interposed between the supply node of the high-potential-side power supply voltage and the output node, and further, whose gate receives the control voltage.

9. The circuit according to claim 8, wherein the output circuit further includes a pair of resistors connected in series between the output node and the supply node of the low-potential-side power supply voltage, and the divided voltage is generated in a serial connection node of the paired resistors.

10. The circuit according to claim 7, wherein said at least one second N-type MOS transistor is two N-type MOS transistors having a current path between source and drain, which is interposed in series between the supply node of the low-potential-side power supply voltage and the output node of the output voltage.

11. The circuit according to claim 7, wherein said at least one second N-type MOS transistor is one N-type MOS transistors having a current path between source and drain, which is interposed between the output node and the supply node of the low-potential-side power supply voltage.

12. The circuit according to claim 7, wherein the control voltage output circuit is a differential amplifier, which has a pair of input terminals receiving the reference voltage and the divided voltage.

13. A constant-voltage power circuit comprising:

a control voltage output circuit receiving a reference voltage and a divided voltage dividing an output voltage, and outputting a control voltage in accordance with the difference between the reference voltage and the divided voltage;

an output circuit receiving the control voltage to generate a stabilized output voltage from a high-potential-side power supply voltage, wherein the output circuit includes an output node to output the stabilized output voltage;

a first P-type MOS transistor carrying a current from the output node;

a first N-type MOS transistor carrying a current into the output node;

a capacitor connected between the output node and a supply node of low-potential-side power supply voltage;

a P-type MOS transistor current control circuit controlling a gate of the first P-type MOS transistor so that a current flowing through the first P-type MOS transistor becomes a constant value; and an N-type MOS transistor current control circuit controlling a gate of the first N-type MOS transistor so that a current flowing through the first N-type MOS transistor becomes a constant value.

14. The circuit according to claim 13, wherein the P-type MOS transistor current control circuit includes:

a first constant-current source having a first terminal and a second terminal, and the first terminal is connected to the supply node of low-potential-side power supply voltage; and at least one second P-type MOS transistor having gate and drain mutually connected, and a current path between source and drain, which is interposed between a supply node of the high-potential-side power supply voltage and the second terminal of the first constant-current source, the N-type MOS transistor current control circuit includes:

a second constant-current source having a first terminal and a second terminal, and the first terminal is connected to the supply node of high-potential-side power supply voltage; and at least one second N-type MOS transistor having gate and drain mutually connected, and a current path between source and drain, which is interposed between a supply node of the low-potential-side power supply voltage and the second terminal of the second constant-current source, wherein the gate of the first P-type MOS transistor is connected to the second terminal of the first constant-current source, and the gate of the first N-type MOS transistor is connected to the second terminal of the second constant-current source.

15. The circuit according to claim 14, wherein the output circuit includes a third P-type MOS transistor having a current path between source and drain, and a gate, and whose current path is interposed between the supply node of the high-potential-side power supply voltage and the output node, and whose gate receives the control voltage.

16. The circuit according to claim 15, wherein the output circuit further includes a pair of resistors connected in series between the output node and the supply node of the low-potential-side power supply voltage, and the divided voltage is generated in a serial connection node of the paired resistors.

17. The circuit according to claim 14, wherein said at least one second P-type MOS transistor is two P-type MOS transistors having a current path between source and drain, which is interposed in series between the supply node of the high-potential-side power supply voltage and the output node, and said at least one second N-type MOS transistor is two N-type MOS transistors having a current path between source and drain, which is interposed in series between the supply node of the low-potential-side power supply voltage and the output node.

18. The circuit according to claim 13, wherein the control voltage output circuit is a differential amplifier, which has a pair of input terminals receiving the reference voltage and the divided voltage.

* * * * *